US006508723B1

(12) United States Patent
Shimosaka

(10) Patent No.: US 6,508,723 B1
(45) **Date of Patent: *Jan. 21, 2003**

(54) GOLF BALL

(75) Inventor: Hirotaka Shimosaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,654

(22) Filed: Aug. 10, 2000

Related U.S. Application Data

(60) Provisional application No. 60/149,497, filed on Aug. 19, 1999.

(30) Foreign Application Priority Data

Aug. 19, 1999 (JP) ..... 11-232619

(51) Int. Cl.[7] ..... A63B 37/14
(52) U.S. Cl. ..... 473/351; 473/384
(58) Field of Search ..... 473/351, 378, 473/379, 380, 381, 382, 383, 384, 377

(56) References Cited

U.S. PATENT DOCUMENTS 4,560,168 A * 12/1985 Aoyama
4,813,677 A * 3/1989 Oka et al.
5,016,887 A * 5/1991 Jonkouski
5,033,750 A * 7/1991 Yamagishi et al.
5,123,652 A * 6/1992 Oka
5,145,180 A * 9/1992 Oka
5,704,853 A * 1/1998 Maruko et al.
5,735,757 A * 4/1998 Moriyama
5,779,562 A * 7/1998 Melvin et al.
5,800,287 A * 9/1998 Yokota et al.
5,813,924 A * 9/1998 Yamagishi et al.
5,857,925 A * 1/1999 Sullivan et al.
5,911,639 A * 6/1999 Kasashima et al.
6,053,820 A * 4/2000 Kasashima et al.
6,056,650 A * 5/2000 Yamagishi et al.

* cited by examiner

*Primary Examiner*—Stephen Blau
*Assistant Examiner*—Nini F. Legesse
(74) *Attorney, Agent, or Firm*—Sughrue Mion, PLLC

(57) ABSTRACT

A golf ball having a plurality of dimples formed in its surface is characterized in that the sum of dimple trajectory volumes each obtained by multiplying a dimple volume by the square root of a dimple diameter is 580–750, and the ball has a diameter of 42.67–42.97 mm.

10 Claims, 4 Drawing Sheets

GOLF BALL

CROSS REFERENCE TO RELATED APPLICATION

This application is an application filed under 35 U.S.C. §111(a) claiming benefit pursuant to 35 U.S.C §119(e)(i) of the filing date of the U.S. Provisional Application No. 60/149,497 filed on Aug. 19, 1999 pursuant to 35 U.S.C. §111(b).

BACKGROUND OF THE INVENTION

1. Field of the Invention

This invention relates to golf balls (including solid golf balls and wound golf balls).

2. Prior Art

The most requisite characteristic for golf balls is a long flight distance. When run is taken into account, golf balls traveling a low trajectory are mostly advantageous with respect to the total flight distance. Many golf balls having low trajectory performance have been proposed.

In general, an approach of deepening dimples is employed in order to provide low trajectory golf balls. However, such dimples intended for low trajectory suffer from the problem that the flight distance largely varies depending on manufacturing variances. Also, the angle of elevation largely varies with a slight difference of dimples. It is thus difficult to produce in a consistent manner golf balls which are satisfactory in carry.

In the prior art, various proposals were made regarding the overall dimple volume and other indexes associated with the design of dimples. The optimum value of these indexes can largely differ depending on the arrangement of dimples and the combination of large and small dimples. The optimizing efforts in the development of low trajectory-oriented dimples encounter many difficulties. A vast number of working steps and great expenses are needed for the development.

SUMMARY OF THE INVENTION

Therefore, an object of the invention is to provide a golf ball having low trajectory-oriented dimples with stable performance.

Making extensive investigations in order to achieve the above object and analyzing numerous data, the inventor has discovered that the sum of dimple trajectory volumes each obtained by multiplying a dimple volume by the square root of a dimple diameter (or total dimple trajectory volume) governs the angle of elevation of a ball when hit at a high head speed. By adjusting the total dimple trajectory volume to an optimum value, the variation in flight performance of the ball can be minimized. Additionally, by adjusting the dimple cross-sectional shape area ratio to be defined later to an optimum value, low trajectory-producing dimples ensuring a stretching flight in that the carry can be further extended even at the same angle of elevation are developed. It has also been found that better results are obtained by optimizing the number of dimples, the gage and hardness of the cover, and the hardness of the ball.

Accordingly, the invention provides a golf ball as defined below.

(1) A golf ball having a plurality of dimples formed in its surface, characterized in that the sum of dimple trajectory volumes each obtained by multiplying a dimple volume by the square root of a dimple diameter is 580 to 750, and the ball has a diameter of 42.67 to 42.97 mm.

(2) The golf ball of (1) wherein the elevational cross-sectional shape of the dimple at its center has an area $S_1$, multiplying the dimple diameter by a dimple depth gives an area $S_2$, the average of the dimple cross-sectional shape area ratios represented by $S_1/S_2$ is 0.61 to 0.68, and at least 80% of the entire dimples have a dimple cross-sectional shape area ratio of from 0.61 to 0.68.

(3) The golf ball of (1) or (2) wherein the total number of dimples is 360 to 540.

(4) The golf ball of (1), (2) or (3) comprising an outermost cover having a gage of 1.0 to 2.0 mm and a Shore D hardness of 38 to 50.

(5) The golf ball of any one of (1) to (4) comprising a cover of a multilayer structure, wherein a cover layer disposed next to the outermost cover layer has a gage of 1.0 to 2.0 mm, and the ball experiences a compression deformation of 2.6 to 3.4 mm when the load which varies from an initial load of 10 kg to a final load of 130 kg is applied to the ball.

DETAILED DESCRIPTION OF THE INVENTION

Now the present invention is described in further detail.

The golf ball of the invention has a plurality of dimples formed in its surface. The sum of dimple trajectory volumes VT each obtained by multiplying a dimple volume by the square root of a dimple diameter (total dimple trajectory volume TVT) is 580 to 750. Here the lower limit of TVT is at least 580, preferably at least 600, more preferably at least 610, and further preferably at least 620 and the upper limit is up to 750, preferably up to 700, more preferably up to 670, and further preferably up to 640.

Figure 1:
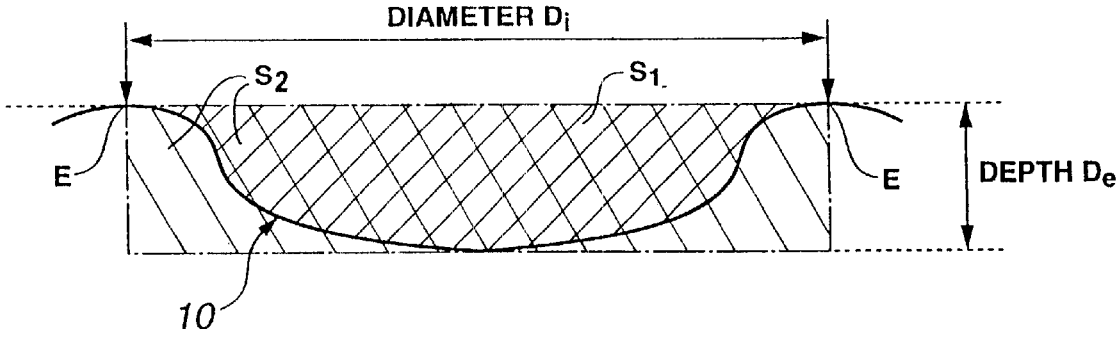
FIG. 1 is a diagram illustrating a dimple shape in the present invention.

According to the invention, in an elevational cross section taken at the center of a dimple 10 as shown in FIG. 1 wherein the left and right highest points in the figure are positioned on a horizontal line and these highest points are designated dimple edges E and E, the dimple 10 has a diameter Di which is equal to the distance between the dimple edges E and E. The dimple 10 has a depth De which is equal to the distance from a line segment connecting the edges E and E to the deepest bottom of the dimple. Then the dimple has a volume V which is the volume of a dimple portion circumscribed by the edges. The elevational cross-sectional shape of the dimple has an area $S_1$ which is given by the hatched portion in FIG. 1.

Specifically, the TVT defined herein is the sum of VT ($=V\times Di^{0.5}$) of dimples. From the value of TVT, the approximate trajectory height of a ball when hit at a high head speed, especially about 50 m/s is determinable. In general, smaller values of TVT lead to greater elevation angles while larger values of TVT lead to less elevation angles. The present invention sets TVT in the range of 580 to 750 as described above. Too small values of TVT lead to a too higher trajectory and hence, an unsatisfactory run and a decline of total flight distance. Inversely, too large values of TVT lead to a too lower trajectory and hence, a short carry and a decline of flight distance. Additionally, outside the range of TVT defined by the invention, variations of carry become greater. In either case, the stability of performance is lost.

Preferably, when the golf ball of the invention is hit with a driver having a loft angle of 7.5° at a head speed of 50 m/s, the ball launches at an elevation angle of at least 8.6°, especially at least 8.7°, and up to 9.3°, more desirably up to 9.2°, further desirably up to 9.1°, most desirably up to 9.0°.

In one preferred embodiment of the invention, provided that the elevational cross-sectional shape of the dimple at its center has an area $S_1$, and multiplying the dimple diameter Di by the dimple depth De gives an area $S_2$, the average SA of the dimple cross-sectional shape area ratio $S_0$ represented by $S_1/S_2$ is 0.61 to 0.68, and at least 80% of the entire dimples have a dimple cross-sectional shape area ratio $S_0$ of from 0.61 to 0.68.

Here, $S_1$, Di, and De are as defined above. $S_2$ is the area of a rectangle delimited by dot-and-dash lines in FIG. 1. SA is the sum of $S_0$ of all the dimples divided by the number of dimples n.

In the practice of the invention, it is preferred that SA is at least 0.61, more preferably at least 0.62, and up to 0.68, more preferably up to 0.67, further preferably up to 0.65. Too smaller values of SA are likely to provide a run-disturbing trajectory whereas too larger values of SA are likely to provide a carry-disturbing trajectory.

Also preferably, at least 80%, more preferably at least 88%, further preferably at least 94% of the entire dimples have a $S_0$ in the range between 0.61 and 0.68. Even with SA within the above-defined range, if at least 80% of the entire dimples do not have a $S_0$ in the above-defined range, there would occur the disadvantages that both carry and run are short.

It is noted that the shape of dimples used herein is generally circular in plane. Preferably the dimples have a diameter of at least 1.8 mm, more preferably at least 2.4 mm, further preferably at least 3.0 mm and up to 4.6 mm, more preferably up to 4.4 mm, further preferably up to 4.2 mm. Preferably the dimples have a depth of at least 0.08 mm, more preferably at least 0.10 mm, further preferably at least 0.12 mm and up to 0.22 mm, more preferably up to 0.20 mm, further preferably up to 0.19 mm.

The total number of dimples (n) is from 360 to 540. More preferably, the total number of dimples is at least 380, further preferably at least 390 and at most 450, further preferably at most 400. Preferred for the dimples used herein are combinations of dimples of at least two types, more preferably at least three types, further preferably at least four types, which are different in diameter, and up to six types, especially up to five types which are different in diameter. These dimples may also be different in depth. Therefore, combinations of dimples of at least four types, especially at least five types and up to ten types, especially up to eight types which are different in VT are preferable.

For the arrangement of the above-described dimples, any well-known technique may be used, and no particular limit is imposed as long as the dimples are evenly distributed. There may be employed any of the octahedral arrangement, icosahedral arrangement, and sphere division techniques of equally dividing a hemisphere into 2 to 6 regions wherein dimples are distributed in the divided regions. Fine adjustments or modifications may be made on these techniques. It is also preferred herein that the dimple surface coverage is 69 to 82%, especially 72 to 77%.

The golf ball of the invention may be either a solid golf ball or a wound golf ball. Accordingly, the core may be either a solid core or a wound core. The invention is applicable to any prior art well-known core although the invention is preferably applicable to a solid golf ball.

Here the solid golf ball may be one comprising a core and a cover. It is preferred from the standpoint of advantageously attaining the object of the invention that the core is formed of a rubber composition and has a diameter of 34 to 40 mm, especially 34 to 38 mm.

The rubber composition used herein is preferably one using polybutadiene as the base. One preferred example of the polybutadiene is 1,4-cis-polybutadiene having at least 40% of cis structure. In the base rubber, natural rubber, polyisoprene rubber, styrene-butadiene rubber or the like may be suitably blended with the polybutadiene, if desired. By increasing the rubber component, the resilience of the golf ball is improved.

Also in the rubber composition, there may be blended a zinc or magnesium salt of an unsaturated fatty acid such as zinc methacrylate or zinc acrylate, or an ester such as trimethylpropane methacrylate as a crosslinking agent. In particular, zinc acrylate is preferably used. The amount of the crosslinking agent blended is preferably from 10 to 30 parts by weight per 100 parts by weight of the base rubber.

In the rubber composition, a vulcanizing agent is usually blended. It is recommended that the vulcanizing agent contains a peroxide in which the temperature giving a half-life period of 1 minute is up to 155° C. The content of the peroxide is at least 30%, especially at least 40% by weight of the entire vulcanizing agent while the upper limit of the content is not critical, but is preferably up to 70% by weight. Such peroxides are commercially available, for example, under the tradename of Perhexa 3M (Nippon Oil and Fats K.K.). The amount of the vulcanizing agent blended is preferably from 0.6 to 2 parts by weight per 100 parts by weight of the base rubber.

Further, if necessary, an antioxidant and zinc oxide or barium sulfate as a filler for specific gravity adjustment may be blended.

The rubber composition may be vulcanized and cured by well-known techniques, producing a solid core. The solid core preferably has a diameter of at least 34 mm, especially at least 35 mm and up to 40 mm, more preferably up to 38 mm, further preferably up to 37 mm.

Also, the cover may be of any prior art well-known cover construction. It may be a single cover although.a multilayer cover construction consisting of two or three or more layers is preferable from the standpoints of a lower spin rate upon driver shots and a higher spin rate upon approach shots.

In this embodiment of the invention, the outermost layer cover preferably has a gage (or thickness) of at least 1.0 mm, especially at least 1.4 mm and up to 2.0 mm, especially up to 1.7 mm and a Shore D hardness of at least 38, more preferably at least 40, further preferably at least 44 and up to 50, more preferably up to 48, further preferably up to 47. With a too small gage, the ball can become less durable whereas a too large gage can lead to a drop of resilience. A too low Shore D hardness can lead to a drop of resilience and shortage of parting smoothness during ball molding whereas a too high Shore D hardness tends to give a hard feel and a lower spin rate upon approach shots.

In the embodiment wherein the cover consists of plural layers, a cover layer next to the outermost layer should preferably have a gage (or thickness) of at least 1.0 mm, especially at least 1.4 mm and up to 2.0 mm, especially up to 1.7 mm. With a too small gage, the ball can become less durable whereas a too large gage can lead to a drop of resilience.

The overall gage of the cover is preferably at least 2.0 mm, especially at least 2.6 mm and up to 4.0 mm, especially up to 3.4 mm.

The cover may be formed of well-known cover-forming thermoplastic resins such as ionomer resins, thermoplastic polyurethane elastomers, and thermoplastic polyester elastomers. Here, the cover layer next to the outermost layer or the inside cover enclosing the core is preferably formed of thermoplastic resins, for example, well-known thermoplastic resins and thermoplastic elastomers. Illustrative examples include nylon, polyarylates, ionomer resins, polypropylene resins, thermoplastic polyurethane elastomers, and thermoplastic polyester elastomers. Exemplary commercially available products include Surlyn AD 8512 (ionomer resin by Dupont), Himilan 1706 and 1707 (ionomer resins by Mitsui Dupont Polychemical K.K.), Rilsan BMNO (polyamide resin by Elf Atochem), and U Polymer U-8000 (polyarylate resin by Unitika K.K.). Ionomer resins are especially preferred.

The golf ball of the invention is generally completed as a product by further coating the cover with a paint. It is preferable from the standpoints of feel and resilience that the golf ball of the invention is formed so as to experience a compression deformation (referred to as $\mu$ hardness, hereinafter) of 2.6 to 3.4 mm when the load which varies from an initial load of 10 kg to a final load of 130 kg is applied to the ball. With too low a $\mu$ hardness, the feel, especially upon shots causing significant deformation to the ball such as driver shots can sometimes be hard. Inversely, too high a $\mu$ hardness would sometimes fail to provide sufficient resilience.

The diameter and weight of the golf ball of the invention comply with the Rules of Golf. From the standpoint of improving flight performance, the ball is formed to a diameter of 42.67 to 42.97 mm. The weight is preferably 44.9 to 45.9 grams.

The invention ensures the efficient manufacture of a golf ball having low trajectory-oriented dimples with stable performance.

EXAMPLE

Examples and Comparative Examples are given below for illustrating the invention, but the invention is not limited to the following Examples.

Examples & Comparative Examples

Solid cores were prepared by a conventional process using the compositions shown in Table 1 (vulcanizing conditions: 155° C. and 15 minutes).

Each of the cores was then enclosed in an inside cover and an outside cover as shown in Table 1. It is noted that the golf ball of Example 6 had a single cover consisting of the outside cover.

TABLE 1

| | (pbw) | Examples 1, 2, 3, 4, 7 Comparative Example | Example 5 | Example 6 |
|---|---|---|---|---|
| Core | Polybutadiene | 100.0 | 100.0 | 100.0 |
| | Dicumyl peroxide | 1.2 | 1.2 | 1.2 |
| | Barium sulfate | 13.1 | 18.0 | 12.5 |
| | Zinc white | 5.0 | 5.0 | 5.0 |
| | Antioxidant | 0.2 | 0.2 | 0.2 |
| | Zinc salt of pentachlorothiophenol | 1.0 | 1.0 | 1.0 |
| | Zinc diacrylate | 27.4 | 27.4 | 27.4 |
| | Diameter (mm) | 36.4 | 35.5 | 38.9 |
| Inside cover | Dynalon 6100P | 30.0 | — | nil |
| | Surlyn AD8511 | 35.0 | — | |
| | Surlyn AD8512 | 35.0 | — | |
| | Surlyn 1557 | — | 50.0 | |
| | Surlyn 1605 | — | 50.0 | |
| | Titanium dioxide | 5.1 | 2.4 | |
| | Gage (mm) | 1.65 | 1.7 | |
| | Shore D hardness | 56 | 60 | |
| Outside cover | PANDEX TR3080 | 50.0 | — | — |
| | PANDEX T7298 | 50.0 | 100.0 | 100.0 |
| | Titanium dioxide | 2.7 | 2.7 | 2.7 |
| | Gage (mm) | 1.5 | 1.9 | 1.9 |
| | Shore D hardness | 45 | 50 | 50 |

Figure 2:
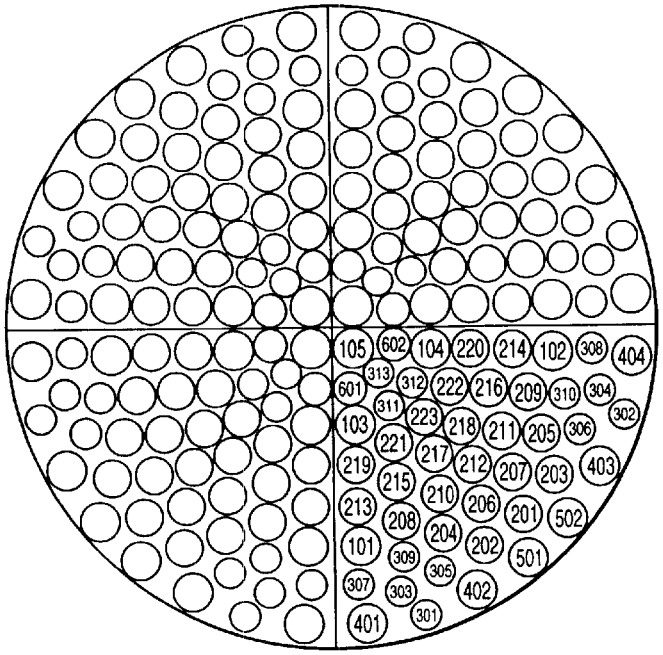
FIG. 2 is a diagram illustrating the arrangement of dimples on the golf balls of Examples 1 to 3 and 5 to 7 and Comparative Example 1.
Figure 3:
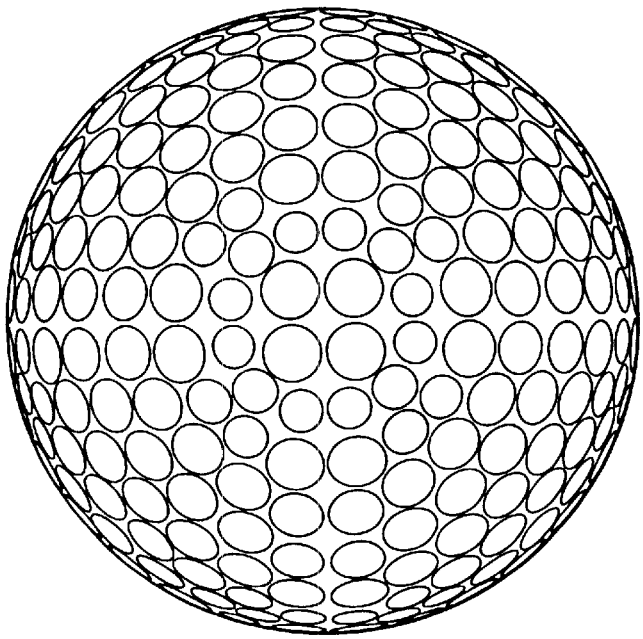
FIG. 3 is a plan view of the same golf ball.
Figure 4:
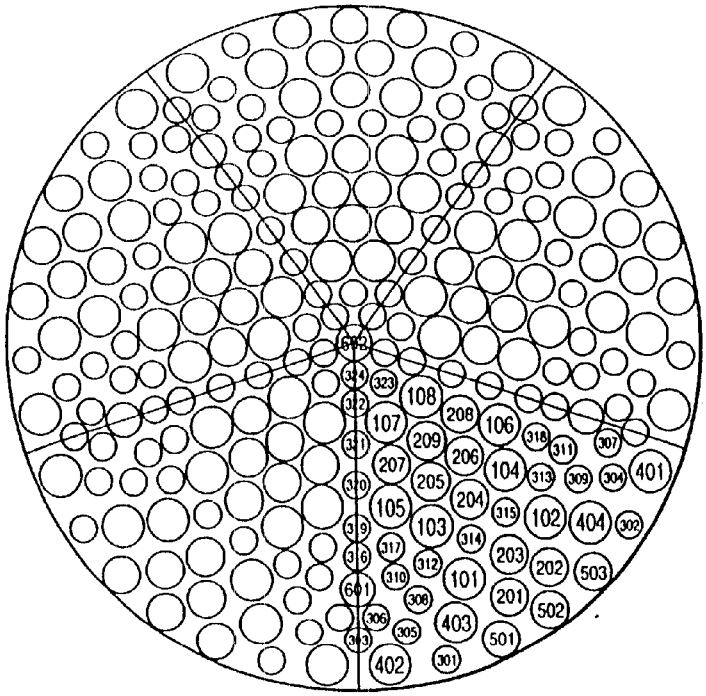
FIG. 4 is a diagram illustrating the arrangement of dimples on the golf ball of Example 4.
Figure 5:
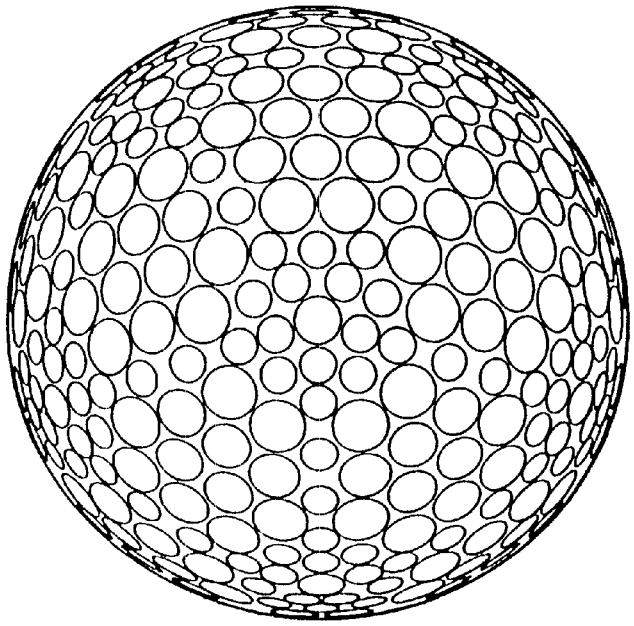
FIG. 5 is a plan view of the same golf ball.
Figure 6:
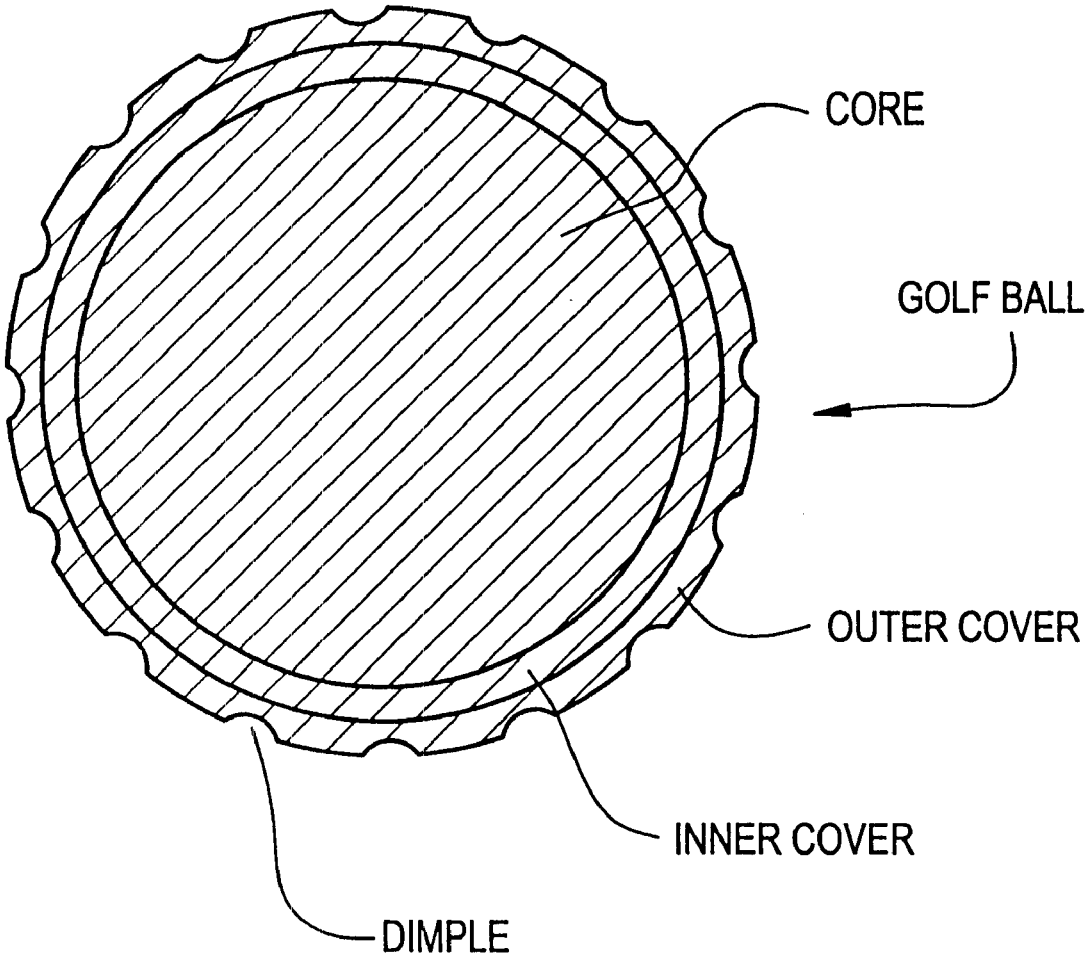
FIG. 6 is a sectional view of a multilayered golf ball of the present invention.

Note:
Dynalon: Japan Synthetic Rubber K.K., block copolymer, hydrogenated butadiene-styrene copolymer
Surlyn: Dupont, ionomer resin
PANDEX: Dainippon Ink & Chemicals K.K., thermoplastic polyurethane elastomer The golf balls were provided on their surface with dimples as shown in Table 2 in the arrangement shown in FIGS. 2 and 3. It is noted that Example 4 employed the arrangement shown in FIGS. 4 and 5. In the figures, the dimples labeled 100s designate dimples (1), the dimples labeled 200s designate dimples (2), and the dimples labeled 300s designate dimples (3) in Table 2 (and so forth).

A flight test was carried out on the thus obtained golf balls by the following procedure. The results are also shown in Table 2.

Flight Test

Using a swing robot manufactured by Miyamae K.K., 20 balls of each Example were hit with a driver at a head speed of 50 m/s. An elevation angle (angle in height direction relative to the horizontal), carry and total distance were measured.

Club Used

Head: manufactured by Bridgestone Sports Co., Ltd., J's METAL, loft angle 7.5°, lie angle 57°, SUS630 stainless steel, lost wax process Shaft: Harmotech Pro, HM-70, LK (low kick point), hardness X

TABLE 2

| | | Example 1 | Example 2 | Example 3 | Example 4 | Example 5 | Example 6 | Example 7 | Comparative Example 1 |
|---|---|---|---|---|---|---|---|---|---|
| Dimple (1) | Dimple number | 40 | 40 | 40 | 80 | 40 | 40 | 40 | 40 |
| | Diameter (mm) | 4.08 | 4.10 | 4.06 | 4.02 | 4.10 | 4.10 | 4.08 | 4.04 |
| | Depth (mm) | 0.16 | 0.16 | 0.19 | 0.18 | 0.16 | 0.16 | 0.18 | 0.17 |
| | $S_0$ | 0.67 | 0.66 | 0.60 | 0.65 | 0.66 | 0.66 | 0.66 | 0.60 |
| | Volume ($mm^3$) | 1.08 | 1.08 | 1.04 | 1.10 | 1.08 | 1.08 | 1.20 | 0.93 |
| | VT ($mm^{3.5}$) | 2.18 | 2.18 | 2.10 | 2.20 | 2.18 | 2.18 | 2.42 | 1.86 |
| Dimple (2) | Dimple number | 184 | 184 | 184 | 90 | 184 | 184 | 184 | 184 |
| | Diameter (mm) | 3.92 | 3.95 | 3.96 | 3.64 | 3.95 | 3.95 | 3.98 | 3.94 |
| | Depth (mm) | 0.15 | 0.15 | 0.18 | 0.18 | 0.15 | 0.15 | 0.17 | 0.16 |
| | $S_0$ | 0.65 | 0.64 | 0.61 | 0.65 | 0.64 | 0.64 | 0.64 | 0.58 |
| | Volume ($mm^3$) | 0.88 | 0.90 | 0.89 | 0.87 | 0.90 | 0.90 | 1.03 | 0.76 |
| | VT ($mm^{3.5}$) | 1.74 | 1.79 | 1.77 | 1.65 | 1.79 | 1.79 | 2.06 | 1.52 |
| Dimple (3) | Dimple number | 104 | 104 | 104 | 240 | 104 | 104 | 104 | 104 |
| | Diameter (mm) | 3.14 | 3.14 | 3.10 | 2.62 | 3.14 | 3.14 | 3.18 | 3.10 |
| | Depth (mm) | 0.13 | 0.13 | 0.14 | 0.15 | 0.13 | 0.13 | 0.13 | 0.13 |
| | $S_0$ | 0.63 | 0.65 | 0.61 | 0.62 | 0.65 | 0.65 | 0.65 | 0.61 |
| | Volume ($mm^3$) | 0.44 | 0.48 | 0.46 | 0.35 | 0.48 | 0.48 | 0.51 | 0.42 |
| | VT ($mm^{3.5}$) | 0.79 | 0.85 | 0.82 | 0.57 | 0.85 | 0.85 | 0.91 | 0.74 |
| Dimple (4) | Dimple number | 32 | 32 | 32 | 40 | 32 | 32 | 32 | 32 |
| | Diameter (mm) | 4.08 | 4.10 | 4.06 | 4.02 | 4.10 | 4.10 | 4.08 | 4.04 |
| | Depth (mm) | 0.19 | 0.18 | 0.20 | 0.19 | 0.18 | 0.18 | 0.20 | 0.19 |
| | $S_0$ | 0.66 | 0.67 | 0.60 | 0.65 | 0.67 | 0.67 | 0.67 | 0.60 |
| | Volume ($mm^3$) | 1.19 | 1.26 | 1.14 | 1.16 | 1.26 | 1.26 | 1.33 | 1.06 |
| | VT ($mm^{3.5}$) | 2.39 | 2.55 | 2.29 | 2.33 | 2.55 | 2.55 | 2.69 | 2.13 |
| Dimple (5) | Dimple number | 16 | 16 | 16 | 30 | 16 | 16 | 16 | 16 |
| | Diameter (mm) | 3.92 | 3.95 | 3.96 | 3.64 | 3.95 | 3.95 | 3.98 | 3.92 |
| | Depth (mm) | 0.17 | 0.18 | 0.20 | 0.19 | 0.18 | 0.18 | 0.19 | 0.18 |
| | $S_0$ | 0.67 | 0.66 | 0.61 | 0.64 | 0.66 | 0.66 | 0.66 | 0.61 |
| | Volume ($mm^3$) | 1.05 | 1.06 | 1.06 | 0.92 | 1.06 | 1.06 | 1.18 | 0.97 |
| | VT ($mm^{3.5}$) | 2.08 | 2.11 | 2.11 | 1.75 | 2.11 | 2.11 | 2.36 | 1.91 |
| Dimple (6) | Dimple number | 16 | 16 | 16 | 12 | 16 | 16 | 16 | 16 |
| | Diameter (mm) | 3.35 | 3.33 | 3.32 | 3.40 | 3.33 | 3.33 | 3.30 | 3.30 |
| | Depth (mm) | 0.15 | 0.15 | 0.13 | 0.17 | 0.15 | 0.15 | 0.16 | 0.12 |
| | $S_0$ | 0.57 | 0.57 | 0.55 | 0.66 | 0.57 | 0.57 | 0.57 | 0.64 |
| | Volume ($mm^3$) | 0.51 | 0.51 | 0.41 | 0.75 | 0.51 | 0.51 | 0.53 | 0.47 |
| | VT ($mm^{3.5}$) | 0.93 | 0.93 | 0.75 | 1.39 | 0.93 | 0.93 | 0.96 | 0.85 |
| Total dimple number | | 392 | 392 | 392 | 492 | 392 | 392 | 392 | 392 |
| Average $S_0$ = SA | | 0.64 | 0.65 | 0.61 | 0.63 | 0.65 | 0.65 | 0.65 | 0.60 |
| Total volume ($mm^3$) | | 313.3 | 323.4 | 313.6 | 333.1 | 323.4 | 323.4 | 360.4 | 278.4 |
| Total dimple trajectory volume ($mm^{3.5}$) | | 612.8 | 633.8 | 613.8 | 623.5 | 633.8 | 633.8 | 708.6 | 543.3 |
| Ball diameter (mm) | | 42.7 | 42.7 | 42.7 | 42.7 | 42.7 | 42.7 | 42.7 | 42.7 |
| Ball weight (g) | | 45.3 | 45.3 | 45.3 | 45.4 | 45.5 | 45.2 | 45.3 | 45.3 |
| Ball $\mu$ hardness (mm) | | 2.9 | 2.9 | 2.9 | 2.9 | 2.7 | 3.1 | 2.9 | 2.9 |
| Flight | Elevation angle (°) | 9 | 8.8 | 9 | 8.9 | 8.7 | 8.9 | 8.5 | 9.4 |
| | Carry (m) | 229 | 227 | 226 | 220 | 230 | 230 | 214 | 226 |
| | Carry standard deviation (m) | 1.2 | 1.5 | 1.8 | 1.6 | 1.3 | 1.3 | 3.5 | 1.7 |
| | Total (m) | 255 | 257 | 250 | 247 | 258 | 248 | 244 | 235 |

Example 1 using a ball of three-piece (3P) structure travels farther with a low trajectory.

Example 2 using dimples having a larger TVT than Example 1 flies with a lower trajectory than Example 1 and travels a less carry, but a better run than Example 1.

Example 3 having a lower $S_0$ than Example 1 shows an equal elevation angle to Example 1, but is somewhat inferior in carry and run to Example 1.

Example 4 having a dimple arrangement completely different from that of Examples 1 to 3, a greater total volume than in Examples 1 to 3, and an intermediate TVT between Examples 1 and 2 shows an intermediate elevation angle between Examples 1 and 2. The flight distance was inferior to those of Examples 1 to 3 due to the influence of the arrangement.

Example 5 is identical with Example 2 except that the hardness and gage of the cover portions are changed and because of this different structure, shows a reduced spin rate, a slightly increased initial velocity, and an increased distance, but a hard feel.

Example 6 is by converting Example 2 into a two-piece (2P) structure and because of this different structure, shows an increased spin rate and a larger elevation angle than Example 2.

Example 7 is a ball having a significantly increased TVT and travels a short carry, but a long run. Because of a fairly low trajectory, the measured distances of carry have a substantial standard deviation.

Comparative Example 1 using conventional intermediate trajectory dimples travels a long carry, but a short run.

What is claimed is:

1. A golf ball comprising a cover of a multilayer structure and having a plurality of dimples formed in its surface, characterized in that the sum of dimple trajectory volumes each obtained by multiplying a dimple volume by the square root of a dimple diameter is 580 to 750, and the ball has a diameter of 42.67 to 42.97 mm and at least four types of the dimples which are different in dimple trajectory volumes, and wherein the elevational cross-sectional shape of the dimple at its center has an area $S_1$, multiplying the dimple diameter by a dimple depth gives an area $S_2$ the average of the dimple cross-sectional shape area ratios represented by $S_1/S_2$ is 0.61 to 0.68, and at least 80% of the entire dimples have a dimple cross-sectional shape area ratio of from 0.61 to 0.68.

2. The golf ball of claim 1 wherein the total number of dimples is 360 to 540.

3. The golf ball of claim 1 comprising an outermost cover having a gage of 1.0 to 2.0 mm and a Shore D hardness of 38 to 50.

4. The golf ball of claim 1, wherein a cover layer disposed next to the outermost cover layer has a gage of 1.0 to 2.0 mm, and the ball experiences a compression deformation of 2.6 to 3.4 mm when the load which varies from an initial load of 10 kg to a final load of 130 kg is applied to the ball.

5. The golf ball of claim 1 wherein the overall gage of the cover is at least 2.6 mm and up to 4.0 mm.

6. The golf ball of claim 1 wherein the outermost layer is formed mainly of thermoplastic polyurethane elastomers.

7. The golf ball of claim 1 wherein the cover layer disposed next to the outermost cover layer is formed mainly of ionomer resins.

8. The golf ball of claim 1 wherein a Shore D hardness of above cover layer disposed next to the outermost cover layer is from 56 to 60.

9. The golf ball of claim 1 wherein the sum of dimple trajectory volumes is 600 to 750.

10. The golf ball of claim 1 wherein the sum of the dimple trajectory volumes is 620 to 750.

* * * * *